US008060265B2

(12) United States Patent
Hallenstvedt et al.

(10) Patent No.: US 8,060,265 B2
(45) Date of Patent: Nov. 15, 2011

(54) METHOD OF STEERING AQUATIC VESSELS

(75) Inventors: Oddbjorn Hallenstvedt, Valskog (SE); Anders L Larsson, Virginia Beach, VA (US)

(73) Assignee: AB Volvo Penta, Gothenburg (SE)

( * ) Notice: Subject to any disclaimer, the term of this patent is extended or adjusted under 35 U.S.C. 154(b) by 1096 days.

(21) Appl. No.: 11/901,073

(22) Filed: Sep. 14, 2007

(65) Prior Publication Data

US 2008/0171479 A1 Jul. 17, 2008

Related U.S. Application Data

(60) Provisional application No. 60/880,651, filed on Jan. 16, 2007.

(51) Int. Cl.
*B60L 3/00* (2006.01)
*B63H 21/22* (2006.01)

(52) U.S. Cl. ..... 701/21; 440/1; 440/53; 440/69; 114/114; 114/162; 114/274; 114/284; 114/285

(58) Field of Classification Search ..... 440/1, 53, 440/69, 89; 701/21; 114/144, 162, 274, 114/284, 285
See application file for complete search history.

(56) References Cited

U.S. PATENT DOCUMENTS 5,326,294 A * 7/1994 Schoell ..... 440/79
5,353,730 A * 10/1994 Talbot ..... 114/248
6,012,408 A * 1/2000 Castillo ..... 114/280
6,045,422 A * 4/2000 Widmann ..... 440/89 R
6,200,175 B1 * 3/2001 Natsume ..... 440/2
6,234,853 B1 * 5/2001 Lanyi et al. ..... 440/53
6,843,195 B2 * 1/2005 Watabe et al. ..... 114/144 E
6,868,317 B2 * 3/2005 Okuyama ..... 701/21
6,994,046 B2 * 2/2006 Kaji et al. ..... 114/144 R
7,036,445 B2 * 5/2006 Kaufmann et al. ..... 114/144 RE
7,153,174 B2 * 12/2006 Takada et al. ..... 440/1
7,186,155 B2 * 3/2007 Nickerson ..... 440/1
7,371,140 B2 * 5/2008 Davis ..... 440/69
7,524,218 B2 * 4/2009 Okuyama ..... 440/1
7,527,537 B2 * 5/2009 Mizutani ..... 440/53
7,762,859 B2 * 7/2010 Suzuki et al. ..... 440/1
7,780,490 B2 * 8/2010 Lundgren ..... 440/1
7,840,318 B2 * 11/2010 Bremsjo ..... 701/21
2006/0166567 A1 * 7/2006 Otobe et al. ..... 440/1
2006/0240720 A1 * 10/2006 Yamashita et al. ..... 440/1
2008/0085640 A1 * 4/2008 Ishida et al. ..... 440/1
2008/0171479 A1 * 7/2008 Hallenstvedt et al. ..... 440/1
2009/0004930 A1 * 1/2009 Larsson ..... 440/1

(Continued)

*Primary Examiner* — Thomas Black
*Assistant Examiner* — Wae Louie
(74) *Attorney, Agent, or Firm* — Martin Farrell; Michael Pruden

(57) ABSTRACT

There is provided a boat (200) including a hull (20), and two engines (30, 50) couplable to rotationally drive mutually spaced separate corresponding propeller assemblies for providing thrusts. Directions of the thrusts are angularly adjustable ($\alpha_1$, $\alpha_2$) relative to the hull (20). A control unit (70) receives first and second user commands ($S_1$, $S_2$) and sends corresponding signals for controlling powers (P1, P2) coupled from the engines (30, 50) to their propeller assemblies. The control unit (70) determines a difference in power ($\Delta P$) to be coupled to the propeller assemblies as a function of the first and second user commands ($S_1$, $S_2$). The control unit (70) controls coupling of power (P1, P2) to the propeller assemblies so that the propeller assemblies develop a difference in thrust which is a function of the difference in power ($\Delta P$). The control unit (70) adjusts angles ($\alpha_1$, $\alpha_2$) of the directions of thrusts as a function of the difference in power ($\Delta P$) to assist the difference in power ($\Delta P$) coupled to the propeller assemblies to enhance maneuverability of the vessel (200).

23 Claims, 5 Drawing Sheets

U.S. PATENT DOCUMENTS

2009/0197486 A1* 8/2009 Szilagyi et al. ..... 440/53
2009/0281685 A1* 11/2009 Larsson et al. ..... 701/21
2010/0330853 A1* 12/2010 Bisht et al. ..... 440/1
2011/0166724 A1* 7/2011 Hiramatsu ..... 701/21

* cited by examiner

METHOD OF STEERING AQUATIC VESSELS

FIELD OF THE INVENTION

The present invention relates to methods of steering aquatic vessels, for example to methods of steering fishing boats, pleasure boats, high speed boats and similar. Moreover, the present invention also concerns apparatus for steering aquatic vessels. Furthermore, the invention relates to software executable on computing hardware for implementing steering control pursuant to the method of the invention.

BACKGROUND TO THE INVENTION

Powered aquatic vessels are well known. Such vessels typically include at least one hull having one or more engines accommodated therein. A mechanical output of each engine is coupled to one or more propellers which are submerged in operation for providing propulsion through water. Moreover, a vessel includes a steering arrangement which involves at least one of pivoting one or more rudders or pivoting one or more propeller assemblies to control a direction of travel and, in the case of stern drive or outboard engines, pivoting the engines to control the direction of travel.

Referring to FIG. 1, there is shown a simplified plan view of a boat indicated generally by 10. The boat 10 may be, for example, a high speed pleasure boat, a high performance fishing vessel, a yacht, or similar vessel. The boat 10 includes an elongated hull 20 having a tapered front bow region at a top of FIG. 1, a truncated rear stern region at a bottom of FIG. 1, a starboard region at a right-hand side of FIG. 1, and a port region at a left-hand side of FIG. 1. Moreover, the boat 10 includes a first port-side engine and an associated drive 30 pivotable in operation by an angle $\alpha_1$ in respect of a longitudinal axis 40 as shown. Furthermore, the boat 10 includes a second starboard-side engine and an associated drive 50 pivotable in operation by an angle $\alpha_2$ in respect of a longitudinal axis 60 as shown. The longitudinal axes 40, 60 are mutually parallel and also parallel to a general longitudinal axis of the hull 20 orientated from the bow region to the stern region. The engines 30, 50 have associated therewith mutually counter-rotating duo-prop propellers, for example, as described in published International Patent Application No. WO 2004/074089 (PCT/SE2004/000206) (Volvo Penta AB). The counter-rotating propellers are either configured in pushing mode or in traction mode depending upon implementation of the boat 10.

The boat 10 further includes a control unit 70 coupled in communication with servo actuators associated with the drives 30, 50 for controlling their orientation angles $\alpha_1$, $\alpha_2$, their power output, and also a direction of rotation of their one or more propellers, namely forward or reverse. The servo actuators (not shown) are optionally implemented using hydraulic actuators or electric motors with associated angular and/or position sensors. Coupling from the control unit 70 is optionally implemented by at least one of a mechanical connection, electric connection, fiber optical connection, and/or wireless communication. The control unit 70 is also coupled for communication with a steering console 80 by which a user is able to steer and control a speed of travel of the boat 10. The steering console 80 includes a rotatable steering wheel 90. The steering console 80 also includes a lever arrangement 100 comprising one or more levers for controlling a direction of rotation of propellers associated with the first and second engines 30, 50 respectively, and also average power output delivered from the engines 30, 50 to their associated propellers. If a fishing boat, and particularly, a deep-sea fishing boat, the boat 10 conventionally has a length on the order to 12 to 15 meters, often referred to by convention as a "40 foot" boat.

Operation of the boat 10 will now be described. When traveling in a forward direction, the lever arrangement 100 is controlled by the user for specifying whether the engines are coupled via the transmission or drive 30, 50 to their associated propellers in a forward gear or a reverse gear. For propelling the boat 10 in a forward direction, the drives 30, 50 associated with the engines are both set in forward gear. Moreover, for propelling the boat 10 in a reverse direction, the drives 30, 50 associated with the engines are both set in reverse gear. The lever arrangement 100 also enables the user to specify a general combined output power of the two engines to their associated propellers. Rotation of the steering wheel 90 correspondingly controls the angles $\alpha_1$, $\alpha_2$ which are substantially mutually similar in operation; in other words, the drives 30, 50 are operable to angularly pivot in synchronism so that substantially $\alpha_1=\alpha_2$ as illustrated in FIG. 1. Moreover, control of direction of travel of the boat 10 in forward and reverse directions is arranged to be akin to selecting forward and reverse gears in a road vehicle. Such disposition of the steering console 80 renders the boat 10 as similar as possible for steering purposes to the user as driving a road vehicle, albeit with effectively back-wheel steering.

The inventors have appreciated that the boat 10 illustrated schematically in plan view in FIG. 1 is not capable of providing a degree of maneuverability that is desirable for certain aquatic operations, for example chasing after large fish, for example, marlin, sailfish, and the like.

Performance of the boat 10 is can be improved by increasing power output of the engines, by increasing responsiveness of the aforementioned servo actuators, and by increasing a maximum range for the steering angles $\alpha_1$, $\alpha_2$. However, such modifications potentially compromise a design of the hull 20, add additional weight to the boat 10, and potentially increase the cost of manufacturing the boat 10.

Thus, the present invention is concerned with addressing a problem that contemporary aquatic vessels are not as maneuverable as desired, especially for specialized operations such a hunting big fish.

SUMMARY OF THE INVENTION

An object of the present invention is to provide an improve method of steering aquatic vessels.

According to a first aspect of the invention, there is provided a method of steering an aquatic vessel including at least one hull and at least one engine couplable to rotationally drive a plurality of mutually spatially separate corresponding propeller assemblies for providing thrusts to propel the vessel through water in operation, wherein directions of the thrusts developed by the plurality of the propeller assemblies are angularly adjustable ($\alpha_1$, $\alpha_2$) relative to the at least one hull, and wherein the vessel is further provided with a control unit for receiving user commands ($S_1$, $S_2$) and for sending corresponding signals for controlling powers (P1, P2) coupled from the at least one engine to the propeller assemblies, the method including steps of:

(a) receiving at least first and second user commands ($S_1$, $S_2$) at the control unit;

(b) in response to receiving the at least first and second user commands ($S_1$, $S_2$), determining a difference in power ($\Delta P$) to be coupled from the at least one engine to the plurality of propeller assemblies as a function of the first and second user commands ($S_1$, $S_2$);

(c) coupling power (P1, P2) to the plurality of propeller assemblies in response to the at least first and second user commands ($S_1$, $S_2$) so that the plurality of propeller assemblies develop a difference in thrust which is a function of the difference in power ($\Delta P$); and (d) adjusting angles ($\alpha_1$, $\alpha_2$) of the directions of thrusts as a function of the difference in power ($\Delta P$) so as to assist the difference in power ($\Delta P$) coupled to the plurality of propeller assemblies to enhance maneuverability of the vessel in operation.

The invention is of advantage in that coordinated control of both the angles ($\alpha_1$, $\alpha_2$) and the difference in power ($\Delta P$) coupled to the propeller assemblies is capable of providing an enhanced degree of aquatic vessel maneuverability.

The method may include a step of controlling said angles ($\alpha_1$, $\alpha_2$), that is, angular orientations, of the plurality of mutually spatially separated propeller assemblies so as to develop their thrusts along corresponding directions which are mutually substantially parallel. For example, as described later, when the vessel includes two mutually similar angularly pivotally mounted propeller assemblies, the two assemblies pivot together with substantially similar associated pivot angles, for example as illustrated in FIG. 2.

Optionally, as a further refinement to improve steering control, the method includes a step of applying an angular correction when controlling the angles ($\alpha_1$, $\alpha_2$), the angular correction being a function of the angles ($\alpha_1$, $\alpha_2$) and a speed of the vessel in water in operation. Such correction is also known generally as "Ackerman" correction.

According to an embodiment of the method, the function relating the difference in power ($\Delta P$) with the angles ($\alpha_1$, $\alpha_2$) of the thrusts of the propeller assemblies relative to the at least one hull includes at least one of: a linear function, a polynomial function, a logarithmic function, an exponential function. Such functions fundamentally affect a steering "feel" of the vessel when in operation. Such "feel" can be very important to vessel control when struggling to capture a large fish; poor control of the vessel during a struggle can potentially result in the fish pulling the vessel into a dangerous orientation with a risk that the vessel takes on water and sinks.

Optionally, the function relating the difference in power ($\Delta P$) with the angles ($\alpha_1$, $\alpha_2$) of thrusts developed by the propeller assemblies relative to the at least one hull is user selectable via the control unit. The user is thus able to vary the steering "feel" of the vessel to cope with various different vessel steering scenarios.

According to one embodiment of the invention, at least one of the plurality of propeller assemblies includes a mutually counter-rotating pair of propellers. Such counter-rotating propellers are of benefit in that they are potentially capable of developing more thrust for a given propeller diameter before limitations of cavitation are reached.

Optionally, at least one of the propeller assemblies is pivotally mounted in respect of the at least one hull. The at least one propeller assembly may be pivotally servo-actuated in response to signals provided from the control unit.

According to another aspect of the invention, the method comprises the step of generating the first and second user commands in response to user manipulation of a pair of mutually independently adjustable controls.

According to yet another aspect of the invention, the pair of mutually adjustable controls are implemented as two independently adjustable levers, wherein the difference in power ($\Delta P$) is determined as a function of relative positions of the levers, and the angles ($\alpha_1$, $\alpha_2$) also corresponding determined as a function of the relative positions of the levers. Such control using, for example two levers, is in stark contrast with a contemporary trend of using steering wheels in a manner utilized in road vehicles.

According to the invention, the method may include a step of generating the first and second user commands in response to user manipulation of a single control having at least two mutually independently adjustable degrees of freedom.

The single control may be in the form of a joystick. Advantageously, the method is implemented in a "fly-by-wire" manner wherein the joystick is coupled electrically to the control unit so that substantially negligible user physical effort is required to steer the vessel.

Optionally, the method includes a step of implementing the control unit by at least one of computer hardware operable to execute a software product, mechanical logic, and hydraulic logic.

Optionally, in the method, the control unit is user switchable between a conventional mode of steering the vessel and a method pursuant to the present invention as defined in the accompanying claims.

Optionally, the method is adapted for use when fishing for large fish, for example, swordfish or tuna.

According to another aspect of the invention, there is provided an aquatic vessel comprising at least one hull, at least one engine couplable to rotationally drive a plurality of mutually spatially separate corresponding propeller assemblies for providing thrusts to propel the vessel through water in operation, wherein directions of the thrusts developed by the plurality of the propeller assemblies are angularly adjustable ($\alpha_1$, $\alpha_2$) relative to the at least one hull, a control unit for receiving user commands ($S_1$, $S_2$) and for sending corresponding signals for controlling powers (P1, P2) coupled from the at least one engine to the propeller assemblies, wherein the control unit is configured to receive at least first and second user commands ($S_1$, $S_2$), wherein the control unit is operable to determine a difference in power ($\Delta P$) in response to receiving the at least first and second user commands ($S_1$, $S_2$) to be coupled from the at least one engine to the plurality of propeller assemblies as a function of the first and second user commands ($S_1$, $S_2$), wherein the control unit is operable to control coupling of power (P1, P2) to the plurality of propeller assemblies in response to the at least first and second user commands ($S_1$, $S_2$) so that the plurality of propeller assemblies develop a difference in thrust which is a function of the difference in power ($\Delta P$); and wherein the control unit is operable to adjust angles ($\alpha_1$, $\alpha_2$) of the directions of thrusts as a function of the difference in power ($\Delta P$) so as to assist the difference in power ($\Delta P$) coupled to the plurality of propeller assemblies to enhance maneuverability of the vessel in operation.

Optionally, in a vessel according to the invention, the control unit is operable to control the angles ($\alpha_1$, $\alpha_2$) of the plurality of mutually spatially separated propeller assemblies so as to develop their thrusts along directions which are mutually substantially parallel.

Optionally, in a vessel according to the invention, the control unit is operable to apply an angular correction when controlling the angles ($\alpha_1$, $\alpha_2$), the angular correction being a function of the angles ($\alpha_1$, $\alpha_2$) and a speed of the vessel in water in operation.

According to the invention, the function relating the difference in power ($\Delta P$) with the angles ($\alpha_1$, $\alpha_2$) of the thrusts of the propeller assemblies relative to the at least one hull includes at least one of a linear function, a polynomial function, a logarithmic function, and an exponential function.

Optionally, in a vessel according to the invention, the function relating the difference in power ($\Delta P$) with the angles ($\alpha_1$, $\alpha_2$) of thrusts developed by the propeller assemblies relative to the at least one hull is user selectable via the control unit.

According to another aspect of the invention, at least one of the plurality of propeller assemblies may include a mutually counter-rotating pair of propellers.

Alternatively, at least one of the propeller assemblies is pivotally mounted with respect to the at least one hull. Alternatively, the at least one of the propeller assemblies is pivotally servo-actuated in response to signals provided from the control unit.

Optionally, the first and second user commands are generated in response to user manipulation of a pair of mutually independently adjustable controls.

Optionally, the pair of mutually adjustable controls are implemented as two independently adjustable levers, wherein the difference in power ($\Delta P$) is determined as a function of relative spatial positions of the levers, and the angles ($\alpha_1$, $\alpha_2$) are also correspondingly determined as a function of the relative spatial positions of the levers.

Alternatively, the first and second user commands are generated in response to user manipulation of a single control having at least two mutually independently adjustable degrees of freedom. According to yet another alternative, the single control is in the form of a joystick.

Optionally, the control unit is implemented by at least one of computer hardware operable to execute a software product, mechanical logic, and hydraulic logic.

Optionally, to accommodate ergonomics and preferences of different users, the control unit is user switchable between a conventional mode of steering the vessel and a mode of steering wherein the angles ($\alpha_1$, $\alpha_2$) and the difference in power ($\Delta P$) are controlled in combination.

Advantageously, the vessel is adapted for use when fishing for large fish, for example, swordfish and tuna.

According to another aspect of the invention, there is provided a software product stored on a data carrier or conveyed via a signal, said software product being executable on computing hardware for implementing a method according to the invention.

It will be appreciated that features of the invention may be combined without departing from the scope of the invention as defined by the accompanying claims.

BRIEF DESCRIPTION OF THE DRAWING FIGURES

The present invention will be better understood by reference to the detailed description in conjunction with the accompanying drawings, in which.

Figure 2:
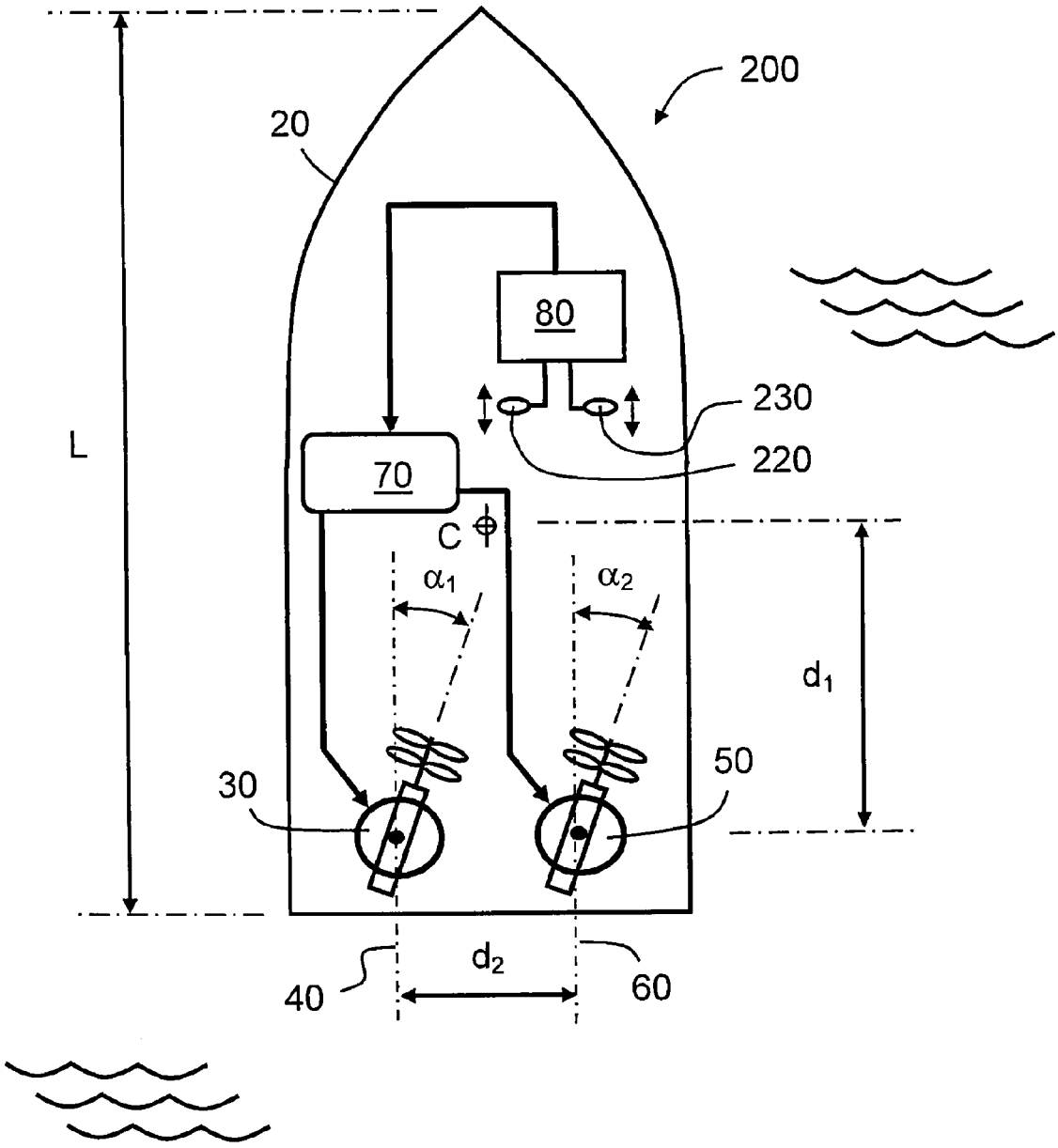
FIG. 2 is a schematic illustrating in plan view of a boat configured pursuant to the present invention.
Figure 3A:
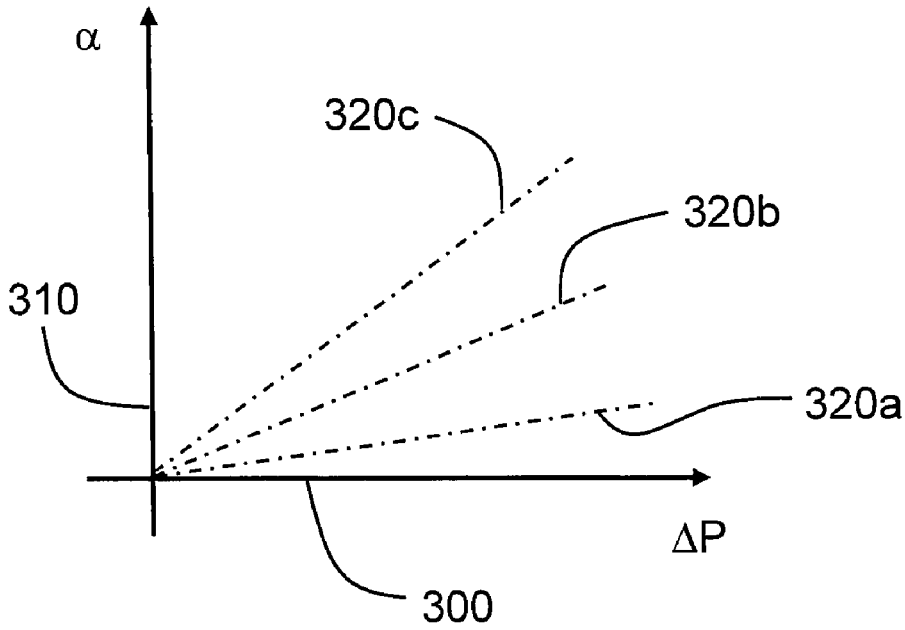
Figure 3B:
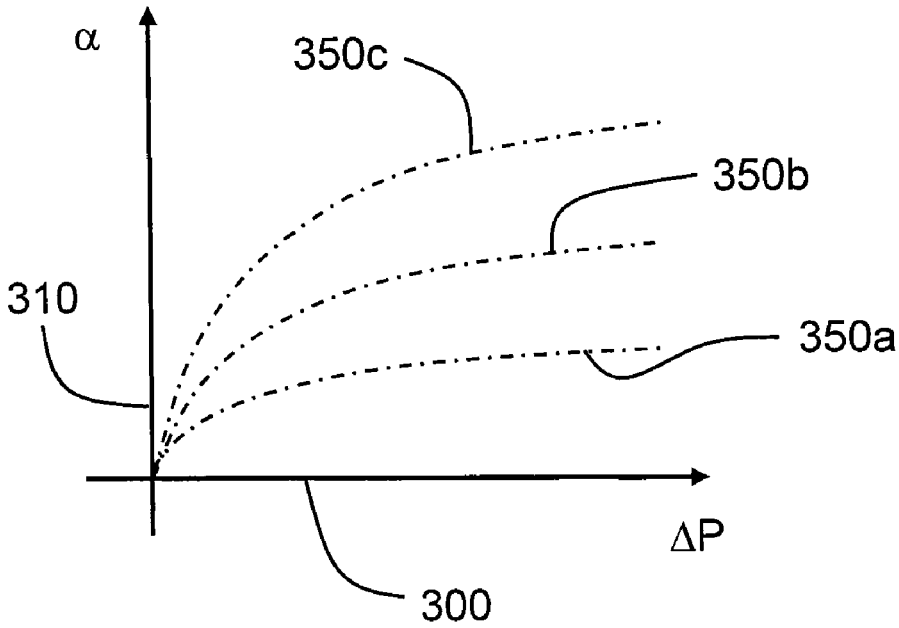
Figure 3C:
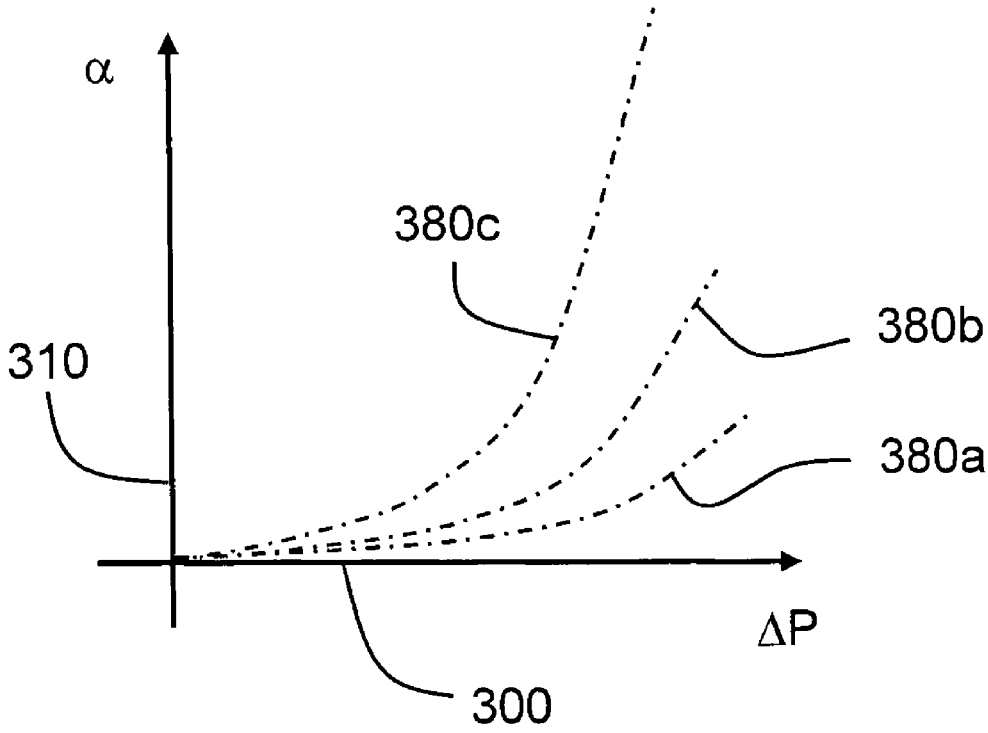
Figure 4A:
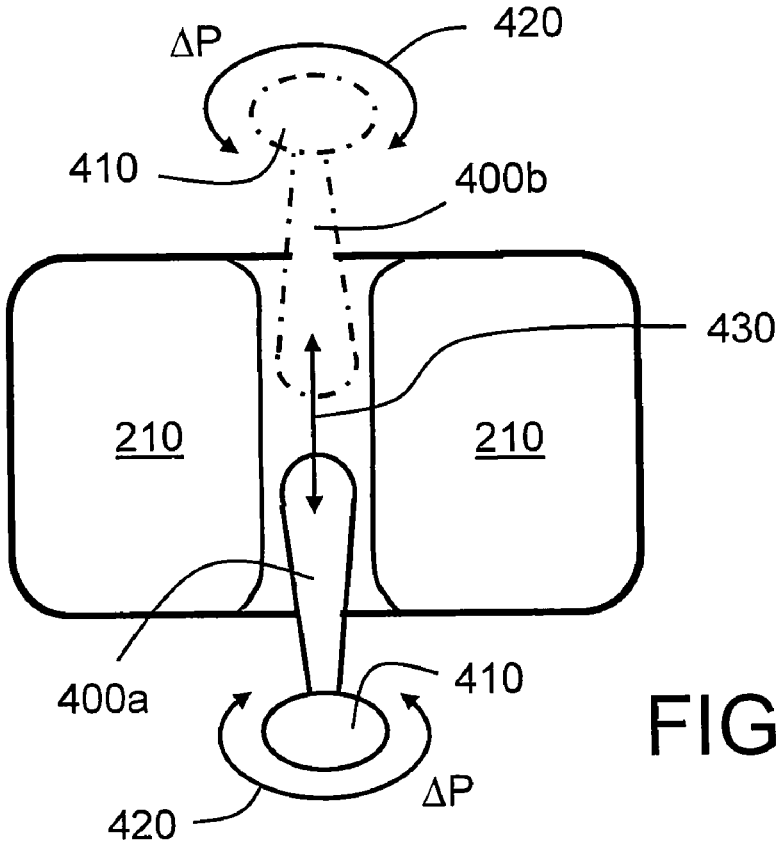
Figure 4B:
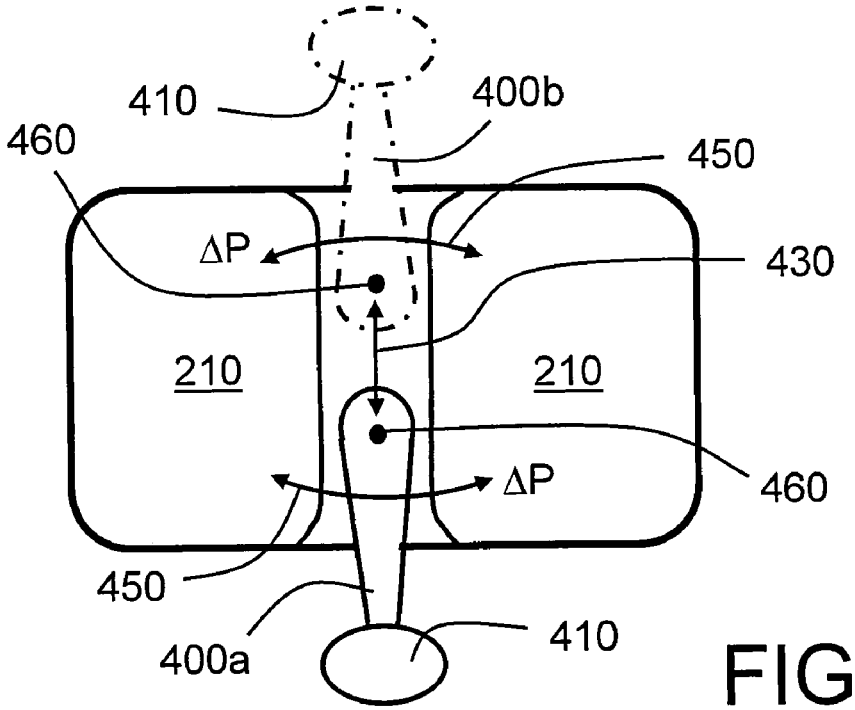

FIGS. 3*a*, 3*b*, and 3*c* are graphs illustrating relationships between a relative power difference specified for the two engines of the boat of FIG. 2 and pivoting angles $\alpha_1$, $\alpha_2$ applied to servo actuators of the engines; and FIGS. 4*a* and 4*b* illustrate exemplary implementations of user controls for the boat of FIG. 2.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS OF THE INVENTION

In overview, the present invention is concerned with methods of steering aquatic vessels to provide them with enhanced maneuverability. The methods concern both angularly orienting a plurality of propeller assemblies in combination with adjusting a difference in the relative engine outputs to provide enhanced vessel maneuverability. Such methods diverge from contemporary methods of steering boats which increasingly mimic a steering function of a road vehicle with steering wheel. The methods of the present invention are mutually distinguished by a manner in which relative power to the plurality of engines is varied in response to angle orientations of the engines and their propeller assemblies, and vice versa.

Referring to FIG. 2, there is shown in schematic plan view a boat configured pursuant to the present invention; the boat is indicated generally by 200. The boat 200 comprises the aforementioned hull 20, the first and second engines (not shown), first and second drives 30, 50 mounted on pivotal mounts with actuators to pivot the drives by angles $\alpha_1$, $\alpha_2$ respectively as shown. The hull 20 has a length L. For an ocean-going sport fishing boat, the length L is typically in a range of 10 to 20 meters, which corresponds to that of a "40-foot" class boat. The drives 30, 50 are mounted on the hull 20 of the boat so that their pivot points are spatially separated by a distance $d_2$ in a range of 1 meter to 2 meters, more preferably in a range of 1.25 meters to 1.75 meters and most preferable substantially 1.5 meters. Furthermore, the boat 200 has a geometrical center denoted by C. The pivot points of the drives 30, 50 are spaced from the geometrical center C a distance $d_1$ along the boat 200. The distance $d_1$ is preferably in a range of 3 meters to 5 meters, more preferably in a range of 3.5 metres to 4 meters, and most preferably substantially 3.75 meters.

The boat 200 in FIG. 2 further comprises a control unit 70 including computing hardware operable to execute a software product for implementing the present invention. The software product is optionally loadable onto the computing hardware by way of data carrier readable by the computing hardware or conveyed via a signal to the computing hardware, for example by way of a WLAN link when the boat 200 is stationed in harbor. The steering console 80 is configured differently in the boat 200 of FIG. 2 in comparison to the boat 10 illustrated in FIG. 1. In FIG. 2, the steering console 80 is equipped with first and second levers 220, 230 for controlling power output of the first and second engines and reverse/forward shifting of the first and second drives 30, 50 respectively. Preferably, the first and second levers 220, 230 each have a central position corresponding to neutral. Pushing the first and second levers 220, 230 forward away from the user engages forward gears of the first and second drives 30, 50 respectively. Power output from the first and second engines progressively increases as the first and second levers 220, 230 respectively are pushed progressively forward. Similarly, pulling the first and second levers 220, 230 backwards towards the user engages reverse gears of the first and second drives 30, 50 respectively. Power output from the first and second engines also progressively increases as the first and second levers 220, 230 respectively are pulled progressively backward towards the user.

The first and second levers 220, 230 may be configured to be mutually independently controlled by the user. For example, the first lever 220 can be pulled back towards the user in operation to place the first drive 30 in reverse gear, while the second lever 230 can be pushed forwards away from the user in operation to place the second drive 50 into forward gear. Moreover, the first and second levers 220, 230 can be user manipulated to demand mutually different levels of power output from the first and second engines 30, 50 respectively. Such a degree of control is not possible with the steering console 80 and the software product of the control unit 70 implemented pursuant to FIG. 1 for the boat 10.

The pivot angles $\alpha_1$, $\alpha_2$ as shown in FIG. 2 are defined to be positive for purposes of describing the present invention. When operating the boat 200, the control unit 70 is configured so that the pivot angles $\alpha_1$, $\alpha_2$ of the first and second drives 30, 50 respectively are substantially similar. If required, a relatively small "Ackerman" type correction can be applied pursuant to Equation 1 (Eq. 1):

$$\alpha_1=\alpha_2+F(\alpha_1, V_B) \quad \text{Eq. 1}$$

wherein

F="Ackerman" function providing an angular correction which is, in practice, often at least an order of magnitude smaller than the angles $\alpha_1$, $\alpha_2$; and $V_B$=velocity of the boat 200 in water.

The velocity $V_B$ is a temporal function of an average power output for the first and second engines at any given instance of time; it is a temporal function on account of issues of acceleration, namely the boat 200 takes time to attain a given velocity in response to applying a power demand to the first and second engines. The function F is to a first approximation a simple linear function. However, it is optionally a higher order polynomial function when precise refinement of performance of the boat 200 is desired.

When the first and second levers 220, 230 are implemented in a mutually similar manner, a difference in relative positions $S_1$, $S_2$ of the levers 220, 230 respectively, namely how far they are pushed or pulled in respect of the user, determines in operation a difference in power ΔP delivered by the first and second engines, respectively.

In other words, the position SI controls a power P1 provided by the first engine to its propeller assembly, the power P1 having a positive value when the propeller assembly of the first engine is coupled in forward gear, and the power P1 having a negative value when the propeller assembly of the first engine is coupled in reverse gear. Moreover, the position $S_2$ controls a power P2 provided by the second engine to its propeller assembly, the power P2 having a positive value when the propeller assembly of the second engine is coupled in forward gear, and the power P2 having a negative value when the propeller assembly of the second engine is coupled in reverse gear. The difference in power ΔP is equal to a difference between the power values P2 and P1.

Equation 2 (Eq. 2) describes such a relationship:

$$\Delta P=G(S_2-S_1) \quad \text{Eq. 2}$$

wherein, G is a function relating the difference in the relative positions of the first and second levers 220, 230 and a difference in power output ΔP provided by the engines to their propellers. The function G is also a temporal function because the engines are not capable of responding instantaneously to changes in position of the levers 220, 230. The function G is preferably substantially a linear function. The power values P1, P2 delivered from the engines respectively are advantageously approximately proportional in magnitude to the displacement $S_1$, $S_2$ of the levers 220, 230 from their center unbiased positions. Alternatively, the function G is a more complex polynomial function, for example a quadratic or cubic function, or may be a more complex polynomial function that at least approximates a logarithmic- or an exponential-type function. The function G is advantageously implemented at least in part in the software product executable in the computing hardware of the control unit 70.

Figure 1:
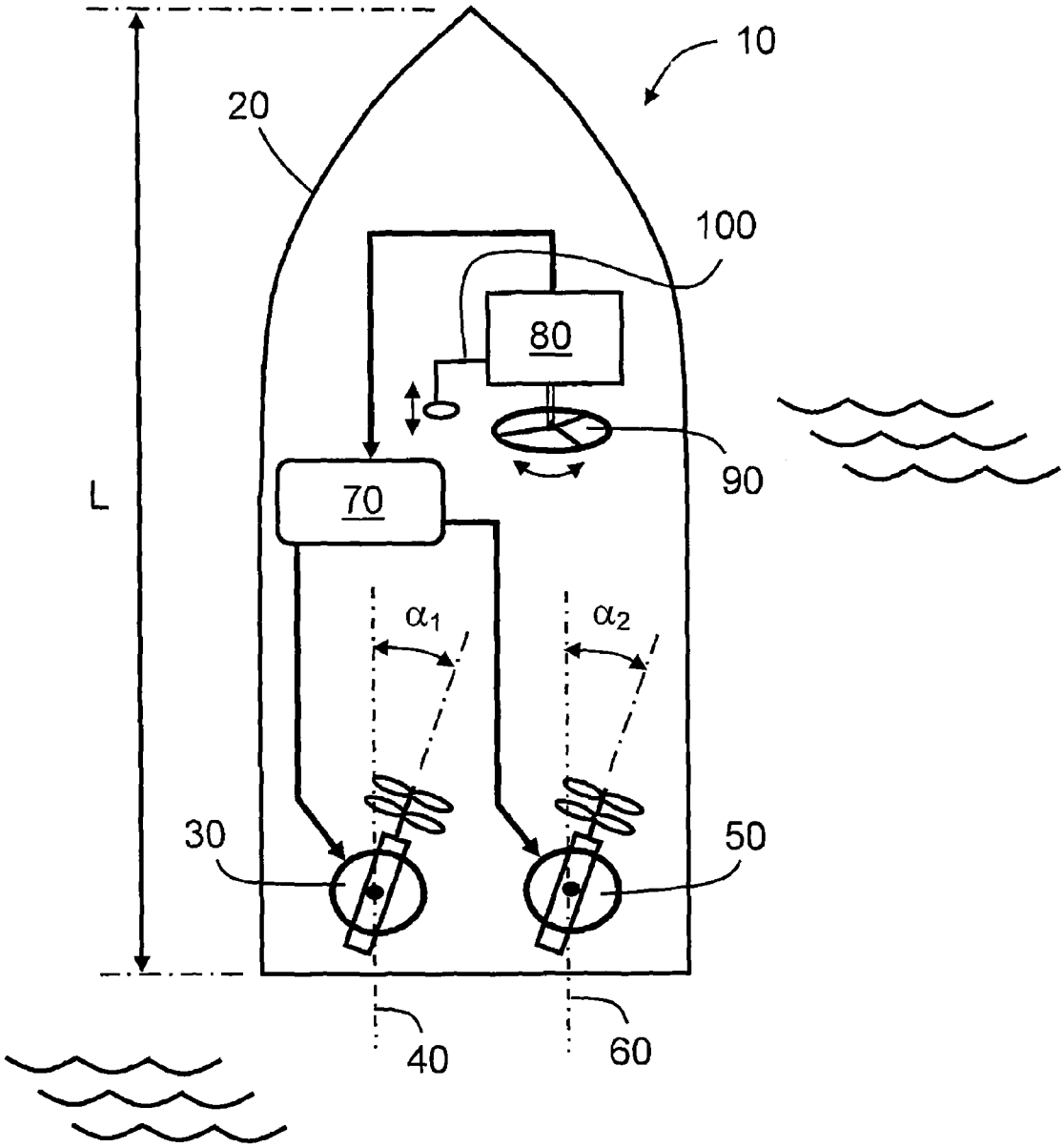
FIG. 1 is a schematic illustration in plan view of a contemporary "40-foot" boat including two engines at a stern region thereof, each engine being coupled to dual counter-rotating propeller assemblies.

The present invention is very significantly distinguished from the boat 10 of FIG. 1 in that, during operation, the angles $\alpha_1$, $\alpha_2$ are controlled, namely servoed by the control unit 70, to be a function of the difference in power output ΔP as described by Equations 3a, 3b (Eqs. 3a, 3b):

$$\alpha_1=H_1(\Delta P) \quad \text{Eq. 3a}$$

$$\alpha_2=H_2(\Delta P) \quad \text{Eq. 3b}$$

wherein $H_1$ and $H_2$ are functions relating the angles $\alpha_1$, $\alpha_2$ (see FIG. 2).

In operation, when the angles $\alpha_1$, $\alpha_2$ are both positive as illustrated in FIG. 2, the first engine is controlled to provide greater forward thrust in comparison to the second engine so that the difference in power ΔP delivered from the engines cooperatively with the pivot angles $\alpha_1$, $\alpha_2$ enhances maneuverability of the boat 200. Optionally, when controlling the boat 200, the first engine may be coupled in forward gear while the second engine is coupled in reverse gear when the angles $\alpha_1$, $\alpha_2$ are positive as illustrated in FIG. 2 to obtain a very tight turning characteristic for the boat 200. Similarly, when the angles $\alpha_1$, $\alpha_2$ are negative as defined in the foregoing, the second engine is controlled to provide a greater forward thrust in comparison to the first engine so that the difference in power ΔP delivered from the engines cooperatively with the pivot angles $\alpha_1$, $\alpha_2$ enhances maneuverability of the boat 200. Optionally, when controlling the boat 200, the second engine may be coupled in forward gear while the first engine is coupled in reverse gear when the angles $\alpha_1$, $\alpha_2$ are negative to obtain a very tight turning characteristic for the boat 200.

The functions $H_1$ and $H_2$ are substantially similar so that the engines of the boat 200 pivot in synchronism in a mutually similar direction as illustrated in FIG. 2. Optionally, the functions $H_1$ and $H_2$ include an "Ackerman" type correction pursuant to Equation 1 (Eq. 1) as an only factor differentiating them.

The functions $H_1$, $H_2$ are substantially linear functions as illustrated in FIG. 3*a*. In FIG. 3*a*, an abscissa axis 300 shows the difference in power ΔP increasing from left to right. There is also included an ordinate axis 310 denoting angles $\alpha_1$, $\alpha_2$ increasing from bottom to top, wherein an intersection of the axes 300, 310 corresponding to ΔP=0 and $\alpha_1$, $\alpha_2$=0. Various scaling factors for the functions $H_1$, $H_2$ are denotes by curves 320*a*, 320*b*, 320*c* can be utilized depending on steering characteristic desired for the boat 200.

According to another aspect, a plurality of scaling factors for the functions $H_1$ and $H_2$ are user selectable at the steering console 80.

Alternatively, for obtaining special steering characteristics, the functions $H_1$ and $H_2$ are non-linear functions as depicted in FIGS. 3*b* and 3*c*. FIG. 3*b* illustrates substantially a logarithmic type function which renders response from the boat 200 in operation to movement of the levers 220, 230 from their center positions very sensitive; such a characteristic renders control of the levers 220, 230 to the user very "twitchy" or "nervous". Conversely, FIG. 3*c* illustrates substantially an exponential-type function which renders response from the boat 200 in operation to movement of the levers 220, 230 insensitive when the boat 200 is traveling substantially directly ahead but very sensitive when the boat 200 is required to do an abrupt turn, for example when chasing a big fish which is writhing and turning on a fishing hook. Other types of polynomial relationships can be employed in the control unit 70 for the functions $H_1$ and $H_2$. Optionally, the functions $H_1$ and $H_2$ are user-switchable between one or more of FIGS. 3*a*, 3*b*, 3*c*, for example by way of one or more user-depressable switches included on the steering console 80. Selection of one of more of the functions F, G, $H_1$, $H_2$, is desirable to provide the boat 200 with an operational "feel" for the user which is conducive, for example, to controlling the boat 200 during a struggle to catch a big fish. However, the present invention is not limited merely to fishing activities; it is also relevant to power-boat racing, competition racing or boat maneuverability tournaments, for example.

The ease with which the user is able to steer the boat 200 is of importance from an ergonomic viewpoint. A fishing boat is typically provided with equipment, for example a boom with winch at a stern region of the boat 200. When attempting to land a fish, a first person may be stationed at the stern region to operate the fish-catching equipment while a pilot is stationed at the steering console 80 to control movement of the boat 200. The pilot needs to respond quickly to support activities of the first person. It is thus highly desirable that controls of the steering console 80 are as ergonomically easy and convenient to operate as possible. Thus, as an alternative to the aforesaid two levers 220, 230, joystick-type controls can be optionally employed at the steering console 80 as illustrated in FIGS. 4*a* and 4*b*.

Referring to FIG. 4*a*, there is illustrated a first type of joystick control for the steering console 80. The first joystick control comprises a joystick unit 210 including a central slot in which a joystick 400 is user-movable in a forward/backward pivotal movement; forward and reverse positions of the joystick 400 are denoted by 400*a*, 400*b* respectively with movement denoted by an arrow 430. The joystick 400 is beneficially spring biased towards its central position so that the boat 200 comes to a standstill if the user is not applying any force to the joystick 400. The position of the joystick 400 in a push/pull direction along the arrow 430 controls average power, namely (P1+P2)/2, demanded from each of the engines to be supplied to their associated one or more propellers.

An end knob 410 at a distal end of the joystick 400 as illustrated is user-rotatable as denoted by an arrow 420. Rotation of the knob 410 is used to control the difference in power ΔP. Rotation of the knob 410 is spring biased so that the knob 410 returns to a central rotational position corresponding to substantially zero difference in power ΔP when the user does not apply any rotational force thereto. When a relatively larger rotation is applied to the knob 410, it can, for example in an extreme case, result in one of the drives 30, 50 being engaged in forward gear and another of the drives 30, 50 being engaged in reverse gear to provide the boat 200 with an impressively small turning circle in operation.

The joystick control illustrated in FIG. 4*a* is of benefit in that the user is potentially capable of controlling travel of the boat 200 using just one hand, thereby leaving the other hand free to perform other functions, for example controlling winching equipment to hoist a large fish on board the boat 200.

Referring next to FIG. 4*b*, there is illustrated a second type of joystick control for the steering console 80. The joystick of FIG. 4*b* is similar to the joystick of FIG. 4*a* except that the knob 410 in FIG. 4*b* is not rotatable. Instead, the joystick 400 is FIG. 4*b* is configured so that it can also be rocked laterally as denoted by an arrow 450 about a pivot point 460, in addition to being movable in the aforesaid push/pull direction as denoted by the arrow 430. In FIG. 4*b*, movement of the joystick 400 laterally controls the aforesaid difference in power ΔP. Moreover, movement of the joystick 400 in FIG. 4*b* in the push/pull direction controls average power developed by the engines. In certain positions of the joystick 400 of FIG. 4*b*, one of the drives 30, 50 may be operating in reverse gear while another of the drives 30, 50 concurrently is susceptible to operating in a forward gear. Such control enables the user employing one hand to control the boat 200 to enable it to perform impressively tight abrupt turns as well as rapidly changing speed within limitation of the engines to provide propulsion via their one or more propellers.

It will be appreciated that the boat 200 can be provided with a steering wheel in a manner akin to FIG. 1 as well as being provided with control levers or one or more joysticks pursuant to FIGS. 2, 4*a*, 4*b*. In such an implementation, the control unit 70 is arranged to execute a software product configured so that control is user-switchable between a conventional mode of steering the boat 200 and a method of steering the boat 200 pursuant to the present invention.

Alternatively, one or more of the drives 30, 50 may be provided with a rudder assembly if required. The rudder assembly is beneficially steerable in its angle relative to its associated drive 30, 50.

The aforementioned "Ackerman" type correction as defined by Equation 1 (Eq. 1) is concerned with a relatively small angular correction to account for a relative difference in water velocity passing by propellers of the drives 30, 50 when performing tight turns, especially at relatively higher speeds. The "Ackerman" correction involves, when a plurality of drives are used (for example the boat 200 has first and second drives 30, 50), pivoting an engine nearest an inside of a tight turn slightly more than an engine furthest from the inside of the tight turn. For example, when the boat 200 performs a tight turn to starboard, the pivot angle $\alpha_2$ of the second drive 50 is rendered slightly greater than the pivot angle $\alpha_1$ of the first drive 30 when an "Ackerman" type correction is applied. As mentioned earlier, use of an "Ackerman" type correction in combination with implementing the present invention is optional.

Although the present invention has been described in the foregoing in respect of the boat 200, it will be appreciated that the present invention is not limited to use in such a configuration and can be adapted for use with other configurations of boats, for example for boats including more than two engines. Moreover, although the boat 200 is described as utilizing dual counter rotating propellers for its drives 30, 50 pursuant to aforesaid International Application No. PCT/SE2004/00206 (WO 2004/074089), the present invention may be used with other propeller configurations, for example single propeller arrangements and triple propeller arrangements. Although implementation of the invention is described in the foregoing in respect of the control unit 70 including computing hardware implemented to execute a software product, it will be appreciated that the control unit 70 can be implemented in dedicated electronic hardware and even using mechanical logic and/or hydraulic logic hardware.

In FIG. 2, the boat 200 is illustrated with the engines and drives 30, 50 mounted at its stern region with corresponding propeller arrangements also located generally near the stern region. However, it will be appreciated that the drives 30, 50 can optionally be mounted more forward in the boat 200 with their corresponding propeller assemblies also located more forward in the boat 200. The present invention is also relevant to a situation wherein the boat 200 is implemented with a plurality of hulls, for example in a catamaran type boat. In such a configuration, each catamaran hull is beneficially provided with its respective engine, drive, and propeller assembly controlled pursuant to the present invention.

Optionally, the boat 200 can be implemented to include a single engine coupled via several variable gearboxes to a plurality of propeller assemblies, wherein each propeller assembly is angularly pivotable in a manner as illustrated in FIG. 2 and controllable pursuant to the present invention.

Modifications to embodiments of the invention described in the foregoing are thus possible without departing from the scope of the invention as defined by the accompanying claims.

Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural.

Numerals included within parentheses in the accompanying claims are intended to assist understanding of the claims and should not be construed in any way to limit subject matter claimed by these claims.

What is claimed is:

1. A method of steering an aquatic vessel having at least one hull, at least one engine coupleable to rotationally drive first and second mutually spaced separate corresponding propeller assemblies for providing thrusts to propel the vessel through water, wherein directions of said thrusts developed by said propeller assemblies are angularly adjustable relative to the at least one hull, and wherein the vessel further includes a control unit for receiving user commands and for sending corresponding signals for controlling power coupled from said at least one engine to said propeller assemblies, said method comprising the steps of:

receiving a first thrust command for said first propeller assembly and a second thrust command for said second propeller assembly at the control unit;

determining a difference in power to be coupled from said at least one engine to said first and second propeller assemblies as a function of said first and second thrust commands;

coupling power to said first and second propeller assemblies so that said propeller assemblies develop a difference in thrust which is a function of said difference in power; and controlling angles of directions of thrusts for said first and second propeller assemblies solely as a function of said difference in power coupled to said first and second propeller assemblies to steer said vessel.

2. A method as claimed in claim 1, further comprising the step of controlling said angles of directions of thrusts for said first and second propeller assemblies so as to develop the associated thrusts along corresponding directions which are mutually substantially parallel.

3. A method as claimed in claim 2, further comprising the step of applying an angular correction when controlling said angles, said angular correction being a function of said angles and a speed of said vessel in water.

4. A method as claimed in claim 1, wherein the step of adjusting said angles of directions of thrust as a function of said difference in power coupled to said first and second propeller assemblies is determined as at least one of a linear function, a polynomial function, a logarithmic function, and an exponential function.

5. A method as claimed in claim 1, further comprising the step of receiving at said control unit a user command selecting a function for setting said angles of said directions of thrust relative to said difference in power coupled to said first and second propeller assemblies.

6. A method as claimed in claim 1, wherein the thrust commands for said first and second propeller assemblies are generated responsive to user manipulation of a pair of mutually independently adjustable controls.

7. A method as claimed in claim 6, wherein the pair of mutually adjustable controls comprises two independently adjustable levers, wherein each of said first and second thrust commands is a function of a relative position of one of the levers.

8. A method as claimed in claim 1, wherein, the first and second thrust commands for said first and second propeller assemblies are generated in response to user manipulation of a single control having at least two mutually independently adjustable degrees of freedom.

9. A method as claims in claim 8, wherein the single control is a joystick.

10. A method as claimed in claim 1, further comprising the step of implementing the control unit by at least one of: computer hardware operable to execute a software product, mechanical logic, hydraulic logic.

11. An aquatic vessel comprising:

at least one hull, at least one engine couplable to rotationally drive at least first and second mutually spaced separate propeller assemblies for providing thrusts to propel the vessel through water, wherein directions of said thrusts developed by said propeller assemblies are angularly adjustable relative to the at least one hull, a control unit for receiving user commands and for sending corresponding signals for controlling power coupled from said at least one engine to said propeller assemblies, said control unit being configured to receive thrust commands for each of said at least first and second propeller assemblies;

said control unit including means for determining a difference in power to be provided to said plurality of propeller assemblies as a function of said thrust commands;

said control unit being configured to control coupling of power to said at least first and second propeller assemblies responsive to said thrust commands so that said propeller assemblies develop a difference in thrust which is a function of said difference in power; and said control unit being configured to control angles of directions of thrusts for each of said at least first and second propeller assemblies solely as a function of said difference in power.

12. A vessel as claimed in claim 11, wherein the control unit is configured to control said angles of directions of thrusts for each of said first and second mutually spaced separated propeller assemblies so as to develop thrust directions which are mutually substantially parallel.

13. A vessel as claimed in claim 11, wherein said control unit is configured to apply an angular correction when controlling said angles, said angular correction being a function of said angles and a speed of said vessel in water.

14. A vessel as claimed in claim 11, wherein said function relating said difference in power with said angles of said thrusts of said propeller assemblies relative to said at least one hull includes at least one of: a linear function, a polynomial function, a logarithmic function, an exponential function.

15. A vessel as claimed in claim 11, further comprising a selector associated with said control unit for selecting a function relating said difference in power with said angles of thrusts developed by said propeller assemblies.

16. A vessel as claimed in claim 11, wherein at least one of said propeller assemblies includes a mutually counter-rotating pair of propellers.

17. A vessel as claimed in claim 11, wherein at least one of the propeller assemblies is pivotally mounted with respect to said at least one hull.

18. A vessel as claimed in claim 17, wherein at least one of the propeller assemblies is pivotally servo-actuated in response to signals provided from said control unit.

19. A vessel as claimed in claims 11, comprising a pair of mutually independently adjustable controls for generating the thrust commands.

20. A vessel as claimed in claim 19, wherein the pair of mutually adjustable controls comprise first and second independently adjustable levers, wherein first and second commands are a function of relative positions of the first and second levers.

21. A vessel as claimed in claim 11, comprising a single control having at least two mutually independently adjustable degrees of freedom for generating the thrust commands.

22. A vessel as claimed in claim 21, wherein the single control is a joystick controller.

23. A vessel as claimed in claim 11, wherein the control unit comprises at least one of computer hardware operable to execute a software product, mechanical logic, and hydraulic logic.

* * * * *